US010350121B2

(12) United States Patent
Bergman

(10) Patent No.: US 10,350,121 B2
(45) Date of Patent: Jul. 16, 2019

(54) ELECTRICALLY POWERED WHEELCHAIR WITH AN ARMREST ADJUSTMENT ARRANGEMENT

(71) Applicant: Permobil AB, Timrå (SE)

(72) Inventor: Håkan Bergman, Timrå (SE)

(73) Assignee: PERMOBIL AB (SE)

( * ) Notice: Subject to any disclaimer, the term of this patent is extended or adjusted under 35 U.S.C. 154(b) by 9 days.

(21) Appl. No.: 15/511,671

(22) PCT Filed: Sep. 16, 2015

(86) PCT No.: PCT/EP2015/071206
§ 371 (c)(1),
(2) Date: Mar. 16, 2017

(87) PCT Pub. No.: WO2016/042021
PCT Pub. Date: Mar. 24, 2016

(65) Prior Publication Data

US 2018/0177653 A1 Jun. 28, 2018

(30) Foreign Application Priority Data

Sep. 19, 2014 (EP) ..... 14185547

(51) Int. Cl.
*A61G 5/04* (2013.01)
*A61G 5/14* (2006.01)
(Continued)

(52) U.S. Cl.
CPC ..... *A61G 5/14* (2013.01); *A61G 5/1059* (2013.01); *A61G 5/1075* (2013.01); *A61G 5/125* (2016.11); *A61G 5/04* (2013.01)

(58) Field of Classification Search
CPC ..... A61G 5/14; A61G 5/125; A61G 5/1059; A61G 5/1075; A61G 5/04
(Continued)

(56) References Cited

U.S. PATENT DOCUMENTS 4,456,086 A * 6/1984 Wier ..... A61G 5/14 180/11
4,637,652 A * 1/1987 Bergenwall ..... A47C 1/035 297/330
(Continued)

FOREIGN PATENT DOCUMENTS

CH 697181 A5 6/2008
CN 101103946 A 1/2008
(Continued)

OTHER PUBLICATIONS

PCT International Search Report, PCT Application No. PCT/EP2015/071206, Int'l filing date of Sep. 16, 2015, dated Oct. 15, 2015, 4 pages.
(Continued)

*Primary Examiner* — Theodore V Adamos
(74) *Attorney, Agent, or Firm* — McAndrews, Held & Malloy, Ltd.

(57) ABSTRACT

An electrically powered wheelchair includes a chassis, seat frame, seat frame tilt and lift system, armrest assembly pivotally coupled to the seat frame, and armrest adjustment arrangement including: a first force transmitting arrangement having a first set of four pivot points and pivotally coupled to: an arm of the seat frame tilt and lift system via a first pivot point of the first set of four pivot points, and lifting member of the seat frame tilt and lift system via a second pivot point of the first set of four pivot points, and a second force transmitting arrangement having a second set of four pivot points and pivotally coupled to: the first force transmitting arrangement via a first pivot point of the second set of four pivot points, the seat frame via a second pivot point of the second set of four pivot points, and the armrest assembly.

13 Claims, 6 Drawing Sheets

(51) Int. Cl.
*A61G 5/10* (2006.01)
*A61G 5/12* (2006.01)

(58) Field of Classification Search
USPC ..... 297/323, 316, 330, DIG. 10
See application file for complete search history.

(56) References Cited

U.S. PATENT DOCUMENTS 5,098,158 A * 3/1992 Palarski ..... A47C 1/022 297/234
5,366,036 A * 11/1994 Perry ..... A61G 5/006 180/65.1
2007/0085396 A1* 4/2007 Hunziker ..... A61G 5/1067 297/330
2009/0218784 A1* 9/2009 Porcheron ..... A61G 5/006 280/250.1
2010/0207354 A1* 8/2010 Hunziker ..... A61G 5/14 280/304.1
2010/0259085 A1* 10/2010 Lindell ..... A61G 5/006 297/354.1
2012/0181832 A1* 7/2012 Lin ..... A61G 5/14 297/330
2013/0278032 A1* 10/2013 Hunziker ..... A61G 5/14 297/340
2016/0106607 A1* 4/2016 Lykkegaard ..... A61G 5/1059 248/421

FOREIGN PATENT DOCUMENTS

| | | | |
|---|---|---|---|
| CN | 101184460 | A | 5/2008 |
| CN | 201542846 | U | 8/2010 |
| CN | 103054674 | A | 4/2013 |
| EP | 1859765 | A | 11/2007 |
| WO | 200067615 | A1 | 11/2000 |
| WO | 2009009913 | A1 | 1/2009 |
| WO | 2009058077 | A1 | 5/2009 |

OTHER PUBLICATIONS

Search Report for Chinese Patent Application No. 2015800503639 dated Jan. 23, 2018, 2 pages.

* cited by examiner

ELECTRICALLY POWERED WHEELCHAIR WITH AN ARMREST ADJUSTMENT ARRANGEMENT

CROSS-REFERENCE TO RELATED APPLICATIONS/INCORPORATION BY REFERENCE

The present application is the U.S. national phase under § 371 of International Application No. PCT/EP2015/071206, having an international filing date of Sep. 16, 2015, which claims priority to EP Patent Application No. 14185547.8, filed Sep. 19, 2014. Each of the above-mentioned prior-filed applications is hereby expressly incorporated herein by reference in its entirety.

TECHNICAL FIELD

The present disclosure generally relates to a wheelchair and in particular to an electrically powered wheelchair arranged to enable tilt of the wheelchair seat.

BACKGROUND

Electrically powered wheelchairs are commonly fitted with a tilt mechanism which allows adjustment of the orientation of a seat frame comprising a seat part and a backrest part. Electrically powered wheelchairs may also be provided with a lift mechanism which allows adjustment of the height of the wheelchair seat. The combination of these two mechanisms can provide seat frame adjustment such as anterior tilting, i.e. forward tilting, posterior tilting, i.e. backwards tilting, and/or elevation of the seat frame. A seat occupant or caretaker may thereby set the seat position according to desire or current need of the occupant.

When the seat position is altered by the tilt mechanism and/or the lift mechanism, it may be desirable to be able to simultaneously control the position of the armrest of the wheelchair to provide optimal support for the wheelchair occupant during tilt/lift operation as well as in the resulting seat position. This is for example the case when the seat frame is being set into an anterior tilt position. During this entire motion it is advantageous to be able to maintain the armrest parallel to ground. The wheelchair occupant can then feel safe during the tilt operation because the occupant may confidently lean against the armrest, as the armrest is parallel to the ground. On the other hand, when the seat frame is tilted back, it is generally perceived to be more comfortable and safe if the armrest is perpendicular to the backrest and not parallel to the ground.

In existing electrically powered wheelchair designs the tilt mechanism and the lift mechanism have typically been separated. The linkage that controls the position of the armrest may then be coupled to a fixed point on the lift mechanism, to which fixed point the armrest adjustment relates to. In this manner, the armrest is kept parallel with ground during a tilt operation.

Today, electrically powered wheelchairs with a different design concerning the lift/tilt functionality are entering the market. These wheelchairs have a common mechanism for providing tilt/lift. A linkage of the type utilised in the separated tilt mechanism and lift mechanism design would not provide armrest adjustment functionality which, for example, is parallel to ground during tilt operation.

SUMMARY

In view of the above, a general object of the present disclosure is to provide an electrically powered wheelchair which solves or at least mitigates the problems of the prior art.

An electrically powered wheelchair comprising a chassis; a seat frame; a seat frame tilt and lift system having a lifting member arranged to provide translational movement of the seat frame relative to the chassis, and a first arm which in cooperation with the lifting member is arranged to tilt the seat frame relative to the chassis; an armrest assembly pivotally coupled to the seat frame; and an armrest adjustment arrangement comprising a first force transmitting arrangement having four pivot points defining the vertices of a first parallelogram, which first force transmitting arrangement is pivotally coupled to the first arm via a first pivot point of the four pivot points defining the vertices of the first parallelogram, and pivotally coupled to the lifting member via a second pivot point of the four pivot points defining the vertices of the first parallelogram; and a second force transmitting arrangement having four pivot points defining the vertices of a second parallelogram, which second force transmitting arrangement is pivotally coupled to the first force transmitting arrangement via a first pivot point of the four pivot points defining the vertices of the second parallelogram, which second force transmitting arrangement is pivotally coupled to the seat frame via a second pivot point of the four pivot points defining the vertices of the second parallelogram, and which second force transmitting arrangement is pivotally coupled to the armrest assembly.

An effect which may be obtainable thereby is that the armrest position can be controlled when the seat frame is actuated by the seat frame tilt and lift system, due to the interaction between the seat frame tilt and lift system, the first force transmitting arrangement, and the second force transmitting arrangement. By means of the first force transmitting arrangement, and in particular by the pivot points formed by the first parallelogram, a pivot point is formed around which the second force transmitting arrangement and the second parallelogram is able to pivot when the seat frame tilt and lift system is operated. The armrest will therefore remain parallel to the ground during the operation of setting the seat frame in an anterior tilt position and when the seat is elevated. Furthermore, the armrest remains perpendicular to the backrest part during posterior tilt operation of the seat frame. When the backrest part is tilted back separately from the seat part, the armrest remains perpendicular to the backrest part. Thus, in general, flexible armrest position adjustment may be provided, which ensures comfort and security to the wheelchair occupant during tilt and lift operations.

According to one embodiment the first pivot point and the second pivot point of the four pivot points defining the vertices of the first parallelogram are the vertices of a first long side of the first parallelogram.

According to one embodiment the first pivot point and the second pivot point of the four pivot points defining the vertices of the first parallelogram are arranged further away from the chassis than a third pivot point and a fourth pivot point of the four pivot points defining the vertices of the first parallelogram.

According to one embodiment the second force transmitting arrangement comprises a force transmitting arm which defines a first long side of the second parallelogram, and wherein the force transmitting arm is pivotally coupled to the first force transmitting arrangement.

According to one embodiment the force transmitting arm is pivotally coupled to the first force transmitting arrangement via the first pivot point of the four pivot points defining the vertices of the second parallelogram.

According to one embodiment a third pivot point of the four pivot points defining the vertices of the second parallelogram coincides with the first pivot point of the four pivot points defining the vertices of the first parallelogram.

According to one embodiment the second pivot point and a third pivot point of the four pivot points defining the vertices of the second parallelogram are the vertices of a first long side of the second parallelogram.

According to one embodiment the first force transmitting arrangement is pivotally coupled to a front end portion of the first arm via the first pivot point of the four pivot points of the vertices defining the first parallelogram.

According to one embodiment a fourth pivot point of the four pivot points defining the vertices of the second parallelogram is translatable.

According to one embodiment the first pivot point and the fourth pivot point of the four pivot points defining the vertices of the second parallelogram are the vertices of a second long side of the second parallelogram.

According to one embodiment an axis defined by the second long side of the second parallelogram intersects an axis defined be the first arm.

According to one embodiment the second pivot point and a third pivot point of the four pivot points defining the vertices of the second parallelogram are arranged further away from the chassis than the first pivot point and the fourth pivot point of the four pivot points defining the vertices of the second parallelogram.

According to one embodiment the first force transmitting arrangement is a first linkage.

According to one embodiment the second force transmitting arrangement is a second linkage.

According to one embodiment the seat frame comprises a backrest part, and wherein the armrest assembly is pivotally coupled to the backrest part.

Generally, all terms used in the claims are to be interpreted according to their ordinary meaning in the technical field, unless explicitly defined otherwise herein. All references to "a/an/the element, apparatus, component, means, etc. are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1:
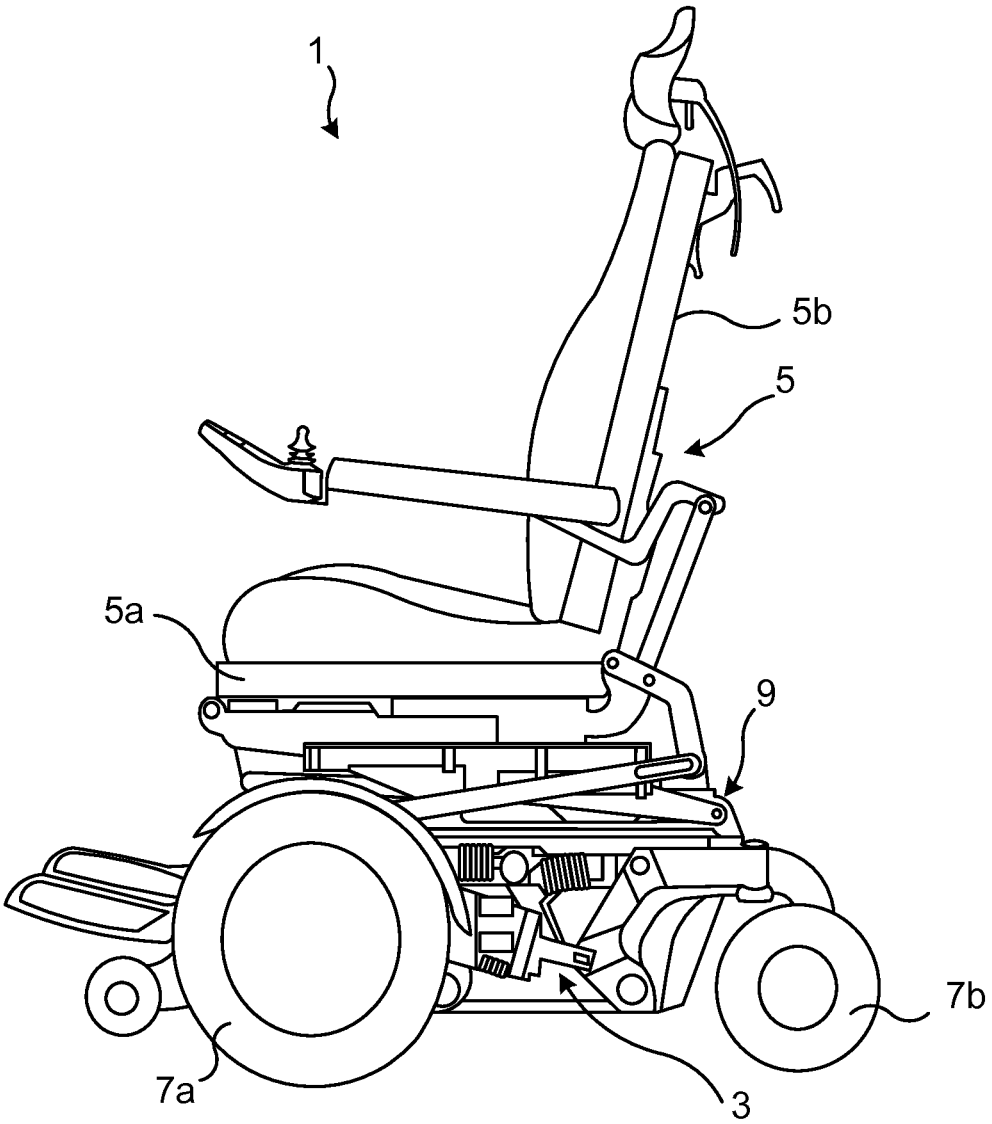
FIG. 1 is a schematic side view of an example of an electrically powered wheelchair which has tilt and lift functionality.

FIG. 1 depicts a schematic side view of an example of an electrically powered wheelchair 1. The electrically powered wheelchair 1 comprises a chassis 3, a seat frame 5 comprising a seat part 5*a* and a backrest part 5*b*, wheels 7*a* and 7*b* and a seat frame tilt and lift system 9 to which the seat frame 5 is mounted.

The seat frame tilt and lift system 9 has a combined lift/tilt mechanism. The seat frame tilt and lift system 9 may be operable by means of a motor and may, depending on the particular implementation, provide one of anterior tilt such as full standing tilt, posterior tilt, and lift, or a combination of anterior/posterior tilt and lift. In FIG. 1, the seat frame tilt and lift system 9 is in a non-elevated and non-tilted state.

Figure 2:
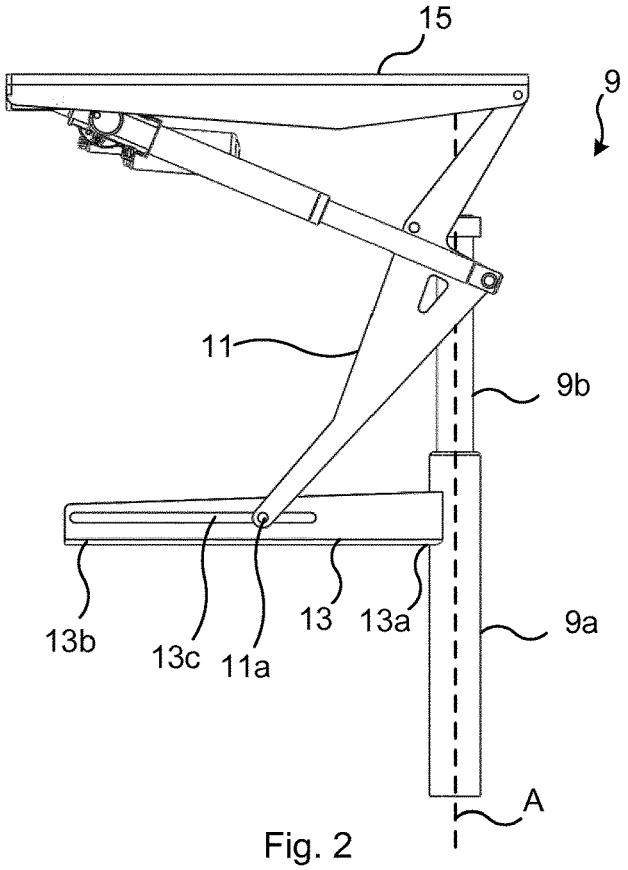
FIG. 2 is a schematic side view of an example of a seat frame tilt and lift system.

FIG. 2 shows one example of a seat frame tilt and lift system 9. The seat frame tilt and lift system 9 comprises a base member 9*a* and a lifting member 9*b*. The base member 9*a* is mountable to the chassis 3 and it is fixedly arranged relative to the chassis 3.

The lifting member 9*b* is arranged to move rectilinearly relative to the base member 9*a*, along an axis A defined by the longitudinal extension of the lifting member 9*a*. The base member 9*a* may for example be arranged to receive the lifting member 9*b* such that the lifting member 9*b* may run in the base member 9*a*.

The lifting member 9*b* is arranged to move rectilinearly between a lowered position in which the lifting member 9*b* is retracted relative to the base member 9*a*, and an elevated or lifted position in which the lifting member 9*b* is extended relative to the base member 9*a*. Actuation of the lifting member 9*b* may for example be performed by means of the motor of the electrically powered wheelchair 1.

The seat frame tilt and lift system 9 further comprises a first arm 11, a second arm 13 and a tilt frame 15. The tilt frame 15 is arranged to support the seat frame 5. The first arm 11 is pivotally coupled to an end portion of the lifting member 9*b* and slidably connected to the second arm 13. The first arm 11 is furthermore pivotally coupled to the tilt frame 15 forming a tilt joint.

According to the example shown in FIG. 2, the second arm 13 is fixedly arranged to the base member 9*a*. In particular, the second arm 13 has a proximal end 13*a* and a distal end 13*b*, wherein the proximal end 13*a* is fixedly attached to the base member 9*a* and the distal end 13*b* which faces away from the base member 9*a* may form a free end.

According to the example in FIG. 2, the second arm 13 has a slot 13*c* which extends between the proximal end 13*a* and the distal end 13*b*. The slot 13*c* is perpendicular or essentially perpendicular to the base member 9*a* and thus the axis A. The first arm 11 has a slot interaction member 11*a* slidably arranged in the slot 13*c* such that the first arm 11 may slide between the two ends of the slot 13*c*. The length of the slot 13*c* is dimensioned such that when the lifting member 9*b* is maximally retracted and in the lowered state, the slot interaction member 11*a* is located at a distal slot end with respect to the base member 9*a* and when the lifting member is maximally extended and in the elevated or lifted position the slot interaction member 11*a* is located at a proximal slot end with respect to the base member 9*a*. The slot interaction member 11*a* hence provides a translatable pivot point of the first arm 11 relative to the second arm 13.

The seat frame tilt and lift system 9 will not be elucidated in more detail herein as it merely provides the setting for the herein disclosed armrest adjustment arrangement. A number of implementations of a seat frame tilt and lift system are envisioned, for example those disclosed in European Patent application EP13176357 filed by the same applicant.

Figure 3:
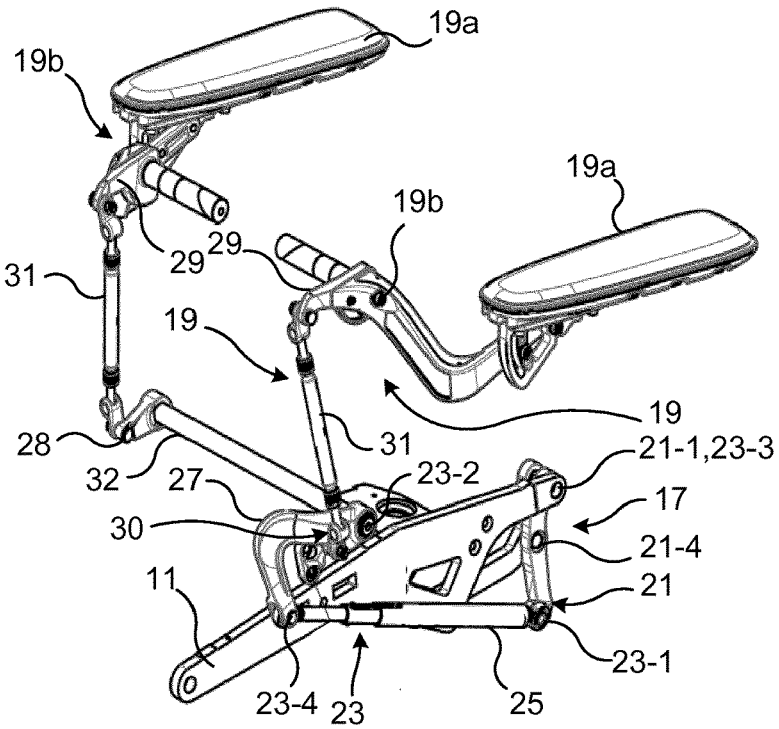
FIG. 3 is a perspective view of an example of an armrest adjustment arrangement.

FIG. 3 shows a perspective view of an example of an armrest adjustment arrangement 17 and an armrest assembly 19, comprising armrests 19*a*, which can be assembled with an electrically powered wheelchair 1. The armrest adjustment arrangement 17 and the armrest assembly 19 are arranged to mechanically interact, such that, for example, while the seat frame tilt and lift system 9 actuates the seat frame 5 to an anterior tilt position, the armrests 19*a* can remain parallel to the ground during the entire motion.

The armrest adjustment arrangement 17 comprises a first force transmitting arrangement 21 and a second force transmitting arrangement 23. The first force transmitting arrangement 21 is pivotally coupled to the seat frame tilt and lift system 9 and to the second force transmitting arrangement 23. The second force transmitting arrangement 23 is pivotally coupled to the armrest assembly 19. Translational and rotational motion provided by the seat frame tilt and lift system 9 can thereby be transmitted from the seat frame tilt and lift system 9 to the armrest assembly 19 via the first force transmitting arrangement 21 and the second force transmitting arrangement 23.

The first force transmitting arrangement 21 comprises a number of members that are arranged to mechanically cooperate so as to transmit movement from the seat frame tilt and lift system 9 to the second force transmitting arrangement 23. The first force transmitting arrangement 21 has four pivot points. Each of the four pivot points is a point on respective axis about which a respective member of the first force transmitting arrangement 21 can pivot. These four pivot points 21-1 to 21-4 define the vertices of a first parallelogram P1, shown in FIG. 4*b*.

The first pivot point 21-1 of the pivot points defining the vertices of the first parallelogram P1 is defined by a pivot coupling between the first force transmitting arrangement 21 and the first arm 11 of the seat frame tilt and lift system 9.

According to one variation, the force transmitting arrangement 21 is a first linkage. In this variation the pivot points of the first linkage define the four pivot points that form the first parallelogram P1.

The second force transmitting arrangement 23 comprises a number of members that are arranged to mechanically cooperate so as to transmit movement from the first force transmitting arrangement 21 to the armrest assembly 19. The second force transmitting arrangement 23 has four pivot points. Each of the four pivot points is a point on a respective axis about which a respective member of the second force transmitting arrangement 23 can pivot. These four pivot points 23-1 to 23-4 define the vertices of a second parallelogram P2, shown in FIG. 5*a* with solid lines.

According to one variation, the second force transmitting arrangement 23 is a second linkage. In this variation the pivot points of the second linkage define the four pivot points that form the second parallelogram P2.

In general, it should be noted that that each axis extending through a pivot point 21-1 to 21-4 and 23-1 to 23-4 which define the vertices of the first parallelogram P1 and the second parallelogram P2 are parallel with the wheel axes.

According to the example shown in FIG. 3, the second force transmitting arrangement 23 comprises a force transmitting arm 25. The force transmitting arm 25 defines one long side of the second parallelogram P2 and is pivotally coupled to the first force transmitting arrangement 21 via a first pivot point 23-1 of the four pivot points defining the second parallelogram P1. The second force transmitting arrangement 23 may further comprise a member 27, in the following referred to as curved member 27, which defines a second pivot point 23-2 and a fourth pivot point 23-4 of the four pivot points defining the vertices of the second parallelogram P2. It should be noted that the member 27 does not necessarily have to be curved. The member 27 is pivotally coupled to the seat frame 5, for example the backrest part 5*b*, via the second pivot point 23-2 and pivotally coupled to the force transmitting arm 25 via the fourth pivot point 23-4. According to one variation, the second pivot point 23-2 is located at one end portion of the curved member 27 and the fourth pivot point 23-4 is located at the other end portion of the curved member 27.

The first pivot point 21-1 of the pivot points defining the vertices of the first parallelogram P1 coincides with a third pivot point 23-3 of the pivot points defining the vertices of the second parallelogram P2.

According to one variation, the fourth pivot point 23-4 of the four pivot points defining the vertices of the second parallelogram P2 is translatable parallel with the direction along which the long sides of the second parallelogram P2 extend, in particular that side of the second parallelogram P2 which is closer to the chassis 3. The fourth pivot point 23-4 of the four pivot points defining the vertices of the second parallelogram P2 is thus translatable along the axis of the longitudinal extension of the force transmitting arm 25. This may for example be achieved by an extendable/retractable force transmitting arm 25, or in case the force transmitting arm is not extendable, by means of a force transmitting arm 25 having a slot in which an end of the curved member 27 can slide. One way of achieving the extendibility/retractability of the force transmitting arm 25 is to let the force transmitting arm 25 comprise two concentric tubes with different inner diameters such that one tube may move and slide within the other. By combining such an alternative with an inner spring, the extendibility can be controlled in a smooth and efficient manner. By being able to translate the fourth pivot point 23-4 of the four pivot points defining the vertices of the second parallelogram P2 in a rectilinear manner, it is possible to decouple the armrest adjustment arrangement 17 to avoid actuation of the armrest assembly 19 during posterior tilt. It should be noted that due to this translation the second parallelogram P2 becomes warped when posterior tilt is performed, as shown in FIG. 5*b*. A mechanical stop preventing the pivoting movement of the member 27 once posterior tilting is activated may be used to ensure that the armrest adjustment arrangement 17 is decoupled. This ensures that when performing posterior tilt, the armrests are maintained in a position essentially perpendicular to the backrest, without the armrest adjustment arrangement 17 influencing the position. Furthermore, for some chassis designs a collision could occur between the chassis and the second force transmitting arrangement if this translatability would not be provided. Thus, by means of the translatability of the fourth pivot point 23-4 it may be ensured that collision of the seat frame 5 with the chassis 3 during tilting operation can be avoided. A greater flexibility in chassis design may thus be provided.

The armrest assembly 19 comprises armrests 19*a* and a pivot arrangement 19*b* that is an extension of the armrests 19*a*. The pivot arrangement 19*b* is pivotally coupled to the seat frame 5, in particular to the backrest part 5*b*. The pivot arrangement 19*b* may for example comprise journals or pivots that extend into respective openings in the backrest part 5*b*, or it may comprise openings into which journals or pivots extend from the backrest part 5*b*. Pivot functionality of the armrests 19*a* may thereby be obtained. The pivot arrangement 19*b* may further comprise pivot arms 29, each of which forms part of a respective armrest 19*a*.

The armrest assembly 19 further comprises an arrangement that at one end is pivotally coupled to the pivot arrangement 19*b* and at the other end to the second force transmitting arrangement 23. The arrangement may for example be realised by means of one or more arms 31 that are pivotally coupled to the second force transmitting arrangement 23, for example to the curved member 27, and to a respective pivot arm 29. The pivotal coupling 30 between the arm 31 and the curved member 27 is displaced relative to the second pivot point 23-2 of the four pivot points defining the vertices of the second parallelogram P2, to enable pivoting of the arm 31 about the second pivot point 23-2.

The armrest assembly 19 may according to one variation further comprise a rod 32 extending transversely, for enabling adjustment of both armrests 19*a*. The rod 32 extends from one lateral side of the electrically powered wheelchair 1 to the other lateral side, parallel to the wheel axes. The rod 32 has a distal end and a proximal end. The proximal end is coupled to the curved member 27 in a manner in which the second pivot point 23-2 of the four pivot points defining the vertices of the second parallelogram P2 is a point on the central axis of the rod 32. The rod 32 is arranged to rotate about its central axis simultaneously, and as a result of the second force transmitting arrangement 23 pivoting about the same axis. The distal end may be provided with a pivot member 28 fixedly arranged relative to the rod 32. An arm 31 is pivotally coupled to the pivot member 28. This arm 31 may furthermore be coupled to the pivot arrangement 19*b* in a similar manner as the other arm 31 to enable actuation of the armrest 19*a* located at the distal lateral side of the electrically powered wheelchair 1 relative to the armrest adjustment arrangement 17.

Motion of the second force transmitting arrangement 23 may thereby be transferred to the pivot arrangement 19*b* for controlling the position of the armrests 19*a*.

Figure 4A:
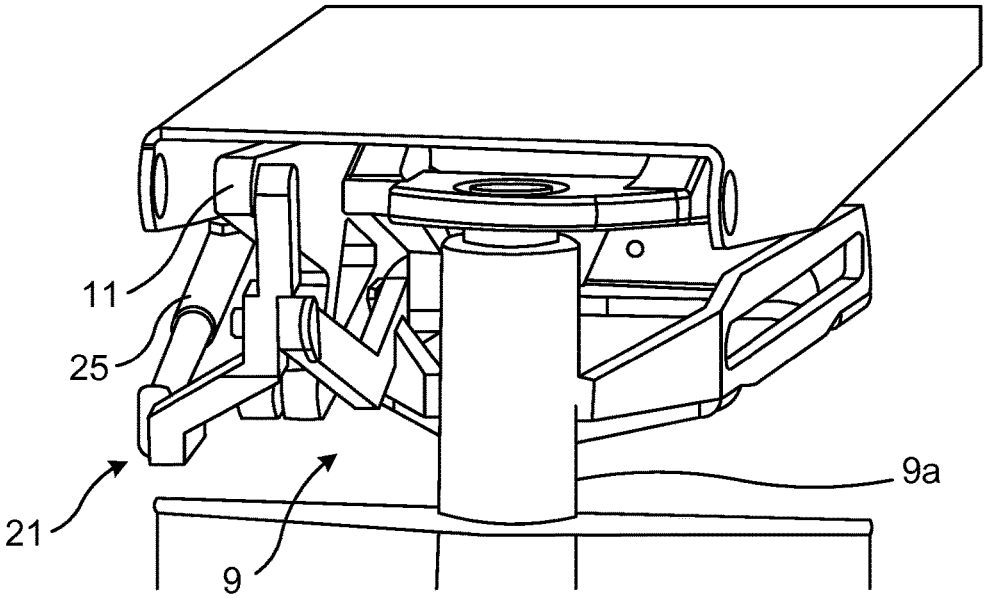
FIG. 4*a* is a perspective view of an armrest adjustment arrangement.
Figure 4B:
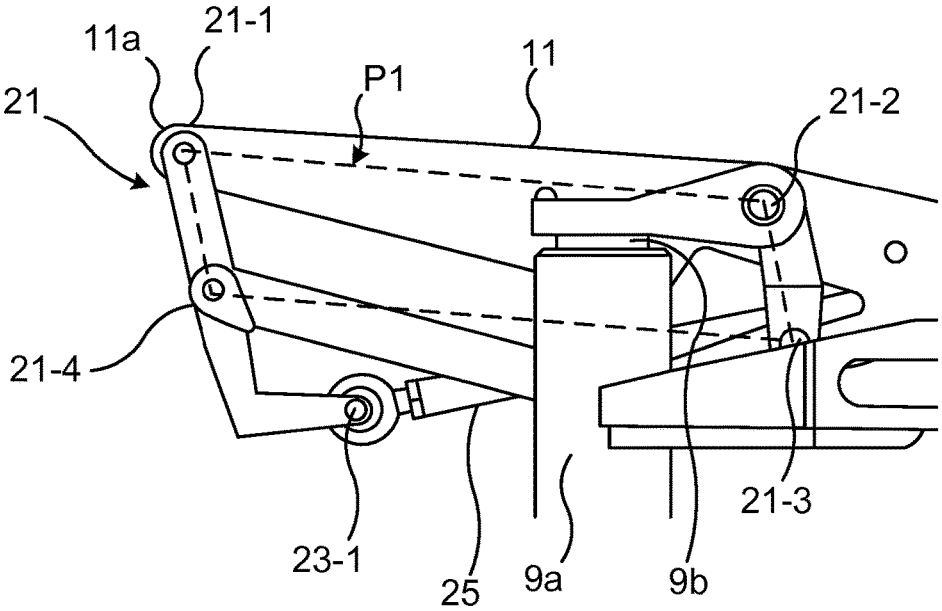
FIG. 4*b* is a cross-sectional view of the armrest adjustment arrangement in FIG. 4*a*.

FIGS. 4*a* and 4*b* show additional views of the first force transmitting arrangement 21, assembled with the seat frame tilt and lift system 9. In the example shown in these figures, the first force transmitting arrangement 21 is a first linkage that is pivotally coupled via the second pivot point 21-2 of the four pivot points forming the first parallelogram P1 to a top portion of the lifting member 9*a*. The first force transmitting arrangement 21 is furthermore pivotally coupled via the first pivot point 21-1 of the four pivot points forming the vertices of the first parallelogram P1 to a front end portion 11*a* of the first arm 11.

According to the example in FIGS. 4*a* and 4*b*, linkage arms of the first force transmitting arrangement 21 connect the four pivot points 21-1 to 21-4 defining the vertices of the first parallelogram P1.

FIGS. 5*a* to 5*e* shows examples of different positions that the seat frame 5 can obtain, in particular a fully lowered non-tilted position, posterior tilt position, elevated position, and variations of anterior or standing tilt positions.

Figure 5A:
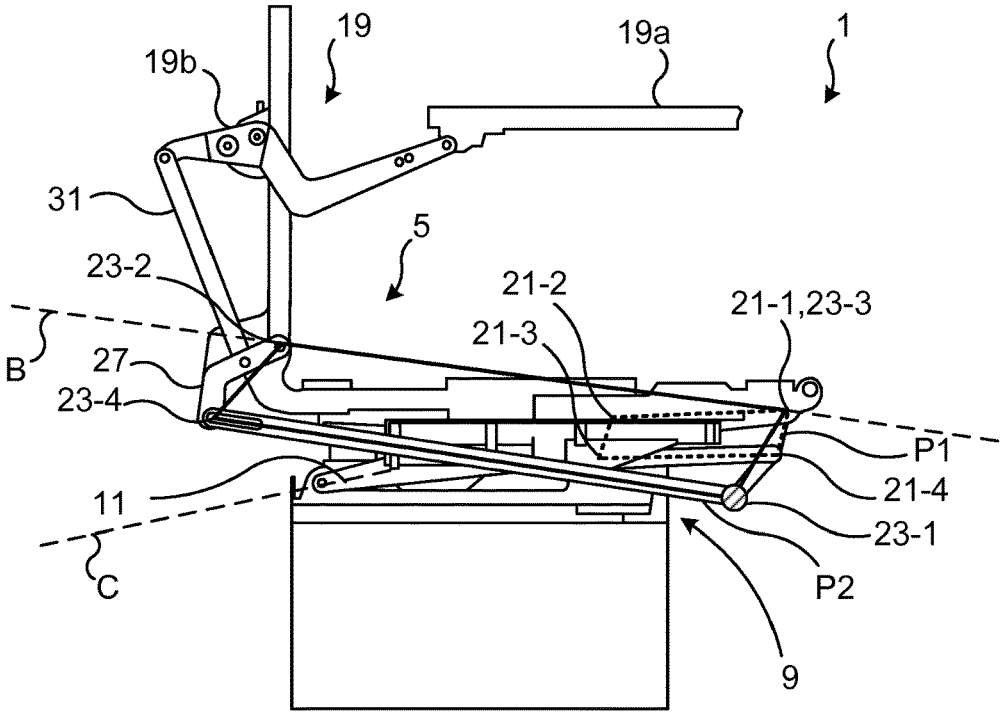
FIGS. 5*a*-5*e* show a seat frame tilt and lift system, an armrest arrangement, and a seat frame in various tilt/lift positions.
Figure 5B:
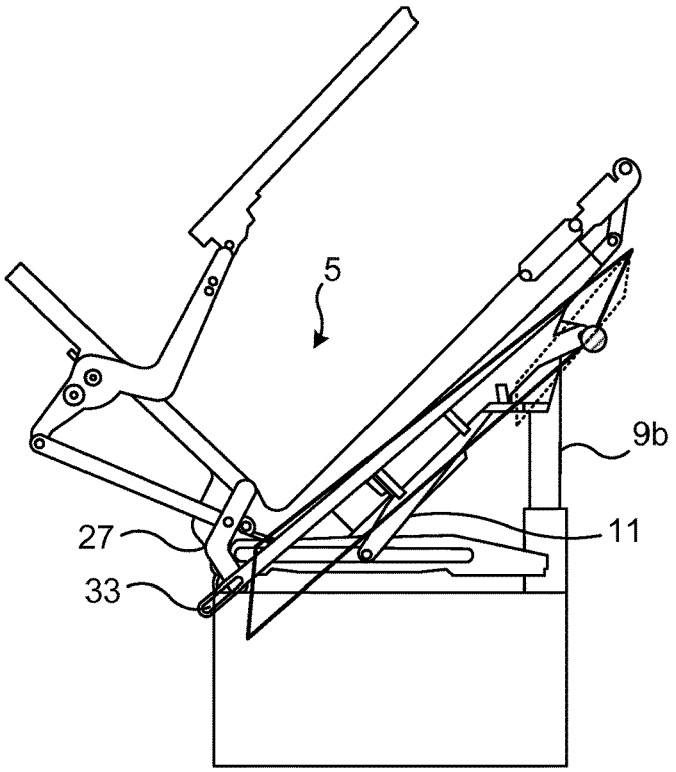

FIG. 5*a* shows a schematic side view of selected portions of an electrically powered wheelchair 1 having a seat frame 5 mounted to a seat frame tilt and lift system 9, an armrest assembly 19 mounted to the seat frame 5, and an armrest adjustment arrangement 17. The seat frame 5 is in a non-elevated, non-tilted state in which the lifting member 9*b* is in a fully retracted state. In the example shown in FIGS. 5*a*-5*e*, a second force transmitting arrangement 23 that has a slot is shown, for enabling translational motion of the fourth pivot point 23-4 of the four pivot points defining the vertices of the second parallelogram P2 and of the force transmitting arm 25.

The first pivot point 21-1 and the second pivot point 21-2 of the four pivot points defining the vertices of the first parallelogram P1, shown with dashed lines in FIGS. 5*a*-5*e*, are arranged further away from the chassis 3 than a third pivot point 21-3 and a fourth pivot point 21-4 of the four pivot points defining the vertices of the first parallelogram P1. The first pivot point 21-1 and the second pivot point 21-2 of the four pivot points defining the vertices of the first parallelogram P1 are the vertices of a first long side of the first parallelogram P1.

The second pivot point 23-2 and a third pivot point 23-3 of the four pivot points defining the vertices of the second parallelogram P2 are arranged further away from the chassis 3 than the first pivot point 23-1 and the fourth pivot point 23-4 of the four pivot points defining the vertices of the second parallelogram P2. The second pivot point 23-2 and a third pivot point 23-3 of the four pivot points defining the vertices of the second parallelogram P2 are the vertices of a first long side of the second parallelogram P2.

An axis B defined by the second long side of the second parallelogram P2 intersects an axis C defined be the first arm 11. This is true for all positions that the first arm 11 and of the second parallelogram P2 can assume relative to each other.

FIG. 5*b* shows the arrangement in FIG. 5*a* in a posterior tilt position.

The translation of the fourth pivot point 23-4 is illustrated in FIG. 5*b*. The force transmitting arm 25 has a slot 33 enabling the curved member 27 to slide relative to the force transmitting arm 25. Compared to the situation shown in FIG. 5*a* an end portion of curved member 27, slidably arranged in the slot 33 and defining the fourth pivot point 23-4, has moved from a distal slot end relative to the chassis 3 to a proximal slot end. As previously noted, the same effect may also be achieved in other ways than through a slot. The effect may for example be achieved by two concentric tubes with different inner diameters, one movable within the other. Further, a separate mechanical stop, preventing the pivotal movement of the member 27 and thus decoupling the armrest adjustment arrangement 17 when posterior tilting is actuated, may be used.

Figure 5C:
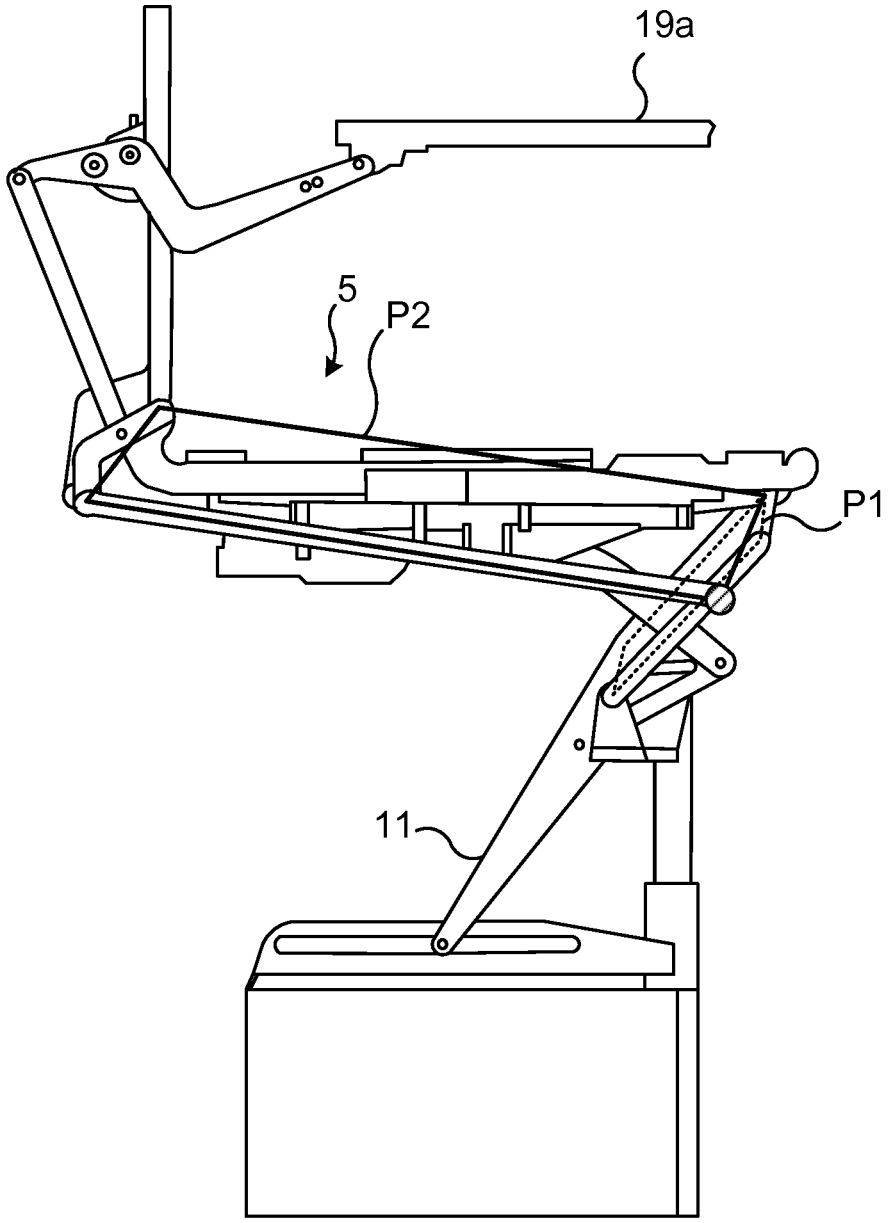
Figure 5D:
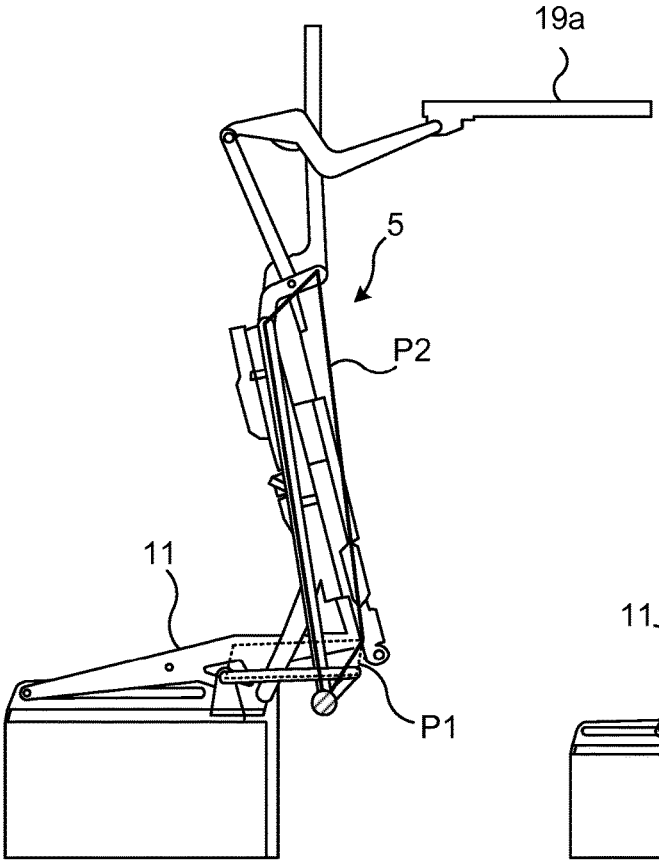
Figure 5E:
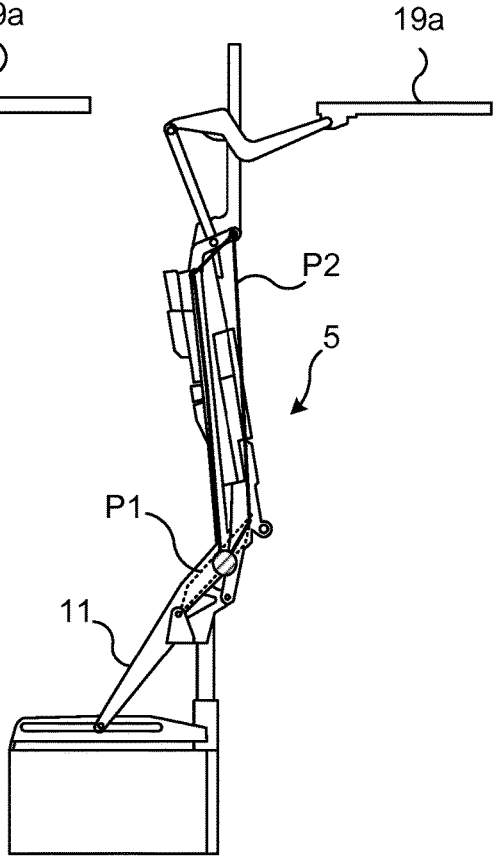

FIG. 5*c* shows the arrangement in FIG. 5*a* in an elevated state, and FIGS. 5*d* and 5*e* shows the arrangement in different anterior tilt positions, a low standing tilt position and a standing tilt position, respectively. By means of the armrest adjustment arrangement 17 the armrests 19 can maintain its parallel position to ground during the entire motion between the states illustrated in FIG. 5*a* and FIGS. 5*d*-5*e*, enabling a wheelchair occupant to confidently and safely lean against the armrests 19 when operating the electrically powered wheelchair between these states.

Although the exemplified electrically powered wheelchair 1 is of front wheel drive type, it should be noted that the wheelchair could be of any wheel drive type such as midwheel drive type, back wheel drive type, four wheel drive type or six wheel drive type.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. An electrically powered wheelchair comprising:

a chassis, a seat frame having a seat part and a backrest part, a seat frame tilt and lift system having a base member fixedly arranged relative to the chassis and a lifting member arranged to be received by the base member and to move rectilinearly relative to the base member along an axis defined by a longitudinal extension of the lifting member to provide translational movement of the seat frame relative to the chassis, and a first arm which in cooperation with the lifting member is arranged to tilt the seat frame relative to the chassis, an armrest assembly comprising an armrest, a pivot arrangement that is an extension of the armrest, and an arm, the pivot arrangement pivotally coupled directly to the backrest part of the seat frame, and an armrest adjustment arrangement comprising:

a first force transmitting arrangement having a first set of four pivot points, the first force transmitting arrangement pivotally coupled to the first arm via a first pivot point of the first set of four pivot points, and pivotally coupled to the lifting member via a second pivot point of the first set of four pivot points, and a second force transmitting arrangement having a second set of four pivot points, the second force transmitting arrangement pivotally coupled to the first force transmitting arrangement via a first pivot point of the second set of four pivot points, the second force transmitting arrangement pivotally coupled directly to the backrest part of the seat frame at a second pivot point of the second set of four pivot points, and the second force transmitting arrangement pivotally coupled to the armrest assembly, wherein the second force transmitting arrangement comprises a force transmitting arm coupling the first pivot point and a fourth pivot point of the second set of four pivot points, and a member coupling the second pivot point and the fourth pivot point of the second set of four pivot points, wherein the fourth pivot point of the second set of four pivot points is translatable along an axis of a longitudinal extension of the force transmitting arm, the force transmitting arm being an extendable and retractable force transmitting arm or the force transmitting arm having a slot in which an end of the member can slide to thereby enable translation of the fourth pivot point of the second set of four pivot points, wherein the arm of the armrest assembly is pivotally coupled to the pivot arrangement and to the member, whereby translational and rotational motion provided by the seat frame tilt and lift system is transmittable from the seat frame tilt and lift system to the armrest assembly via the first force transmitting arrangement and the second force transmitting arrangement, whereby the armrest is actuated to pivot such that the armrest remains parallel to ground during an operation of setting the seat frame in an anterior tilt position and when the seat is elevated, and whereby actuation of the armrest to pivot is prevented such that the armrest remains perpendicular to a backrest part of the seat frame during posterior tilt operation of the seat frame to a posterior tilt position.

2. The electrically powered wheelchair of claim 1, wherein the first set of four pivot points are arranged to define vertices of a first parallelogram shape comprising the vertices, two long sides, and two short sides, the first pivot point and the second pivot point of the first set of four pivot points defining the vertices of a first long side of the first parallelogram shape.

3. The electrically powered wheelchair of claim 1, wherein the first pivot point and the second pivot point of the first set of four pivot points are arranged further away from the chassis than a third pivot point and a fourth pivot point of the first set of four pivot points.

4. The electrically powered wheelchair of claim 1, wherein the force transmitting arm is pivotally coupled to the first force transmitting arrangement.

5. The electrically powered wheelchair of claim 4, wherein the force transmitting arm is pivotally coupled to the first force transmitting arrangement via the first pivot point of the second set of four pivot points.

6. The electrically powered wheelchair of claim 1, wherein a third pivot point of the second set of four pivot points coincides with the first pivot point of the first set of four pivot points.

7. The electrically powered wheelchair of claim 1, wherein the second set of four pivot points are arranged to define vertices of a second parallelogram shape comprising the vertices, two long sides, and two short sides, the second pivot point and a third pivot point of the second set of four pivot points defining the vertices of a first long side of the second parallelogram shape.

8. The electrically powered wheelchair of claim 1, wherein the first force transmitting arrangement is pivotally coupled to a front end portion of the first arm via the first pivot point of the first set of four pivot points.

9. The electrically powered wheelchair of claim 1, wherein the second set of four pivot points are arranged to define vertices of a second parallelogram shape comprising the vertices, two long sides, and two short sides, the first pivot point and the fourth pivot point of the second set of four pivot points defining the vertices of a second long side of the second parallelogram shape.

10. The electrically powered wheelchair of claim 9, wherein an axis defined by the second long side of the second parallelogram shape intersects an axis defined by the first arm.

11. The electrically powered wheelchair of claim 9, wherein the second pivot point and a third pivot point of the second set of four pivot points are arranged further away from the chassis than the first pivot point and the fourth pivot point of the second set of four pivot points.

12. The electrically powered wheelchair of claim 1, wherein the first force transmitting arrangement is a first linkage.

13. The electrically powered wheelchair of claim 12, wherein the second force transmitting arrangement is a second linkage.

* * * * *